US006746138B1

(12) United States Patent
Neeld et al.

(10) Patent No.: US 6,746,138 B1
(45) Date of Patent: Jun. 8, 2004

(54) SUPPORT PLATE FOR A LUMINAIRE

(75) Inventors: James N. Neeld, Tiverton, RI (US); Thomas J. Gamache, Fall River, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/156,252

(22) Filed: May 28, 2002

(51) Int. Cl.[7] ..... F21V 19/00

(52) U.S. Cl. ..... 362/414; 248/219.2; 248/222.41; 362/457; 362/263

(58) Field of Search ..... 362/382, 410, 362/414, 431, 263, 264, 457; 248/219.2, 219.4, 222.41

(56) References Cited

U.S. PATENT DOCUMENTS

| | | | | | |
|---|---|---|---|---|---|
| 428,358 | A | | 5/1890 | Stevens | |
| 446,826 | A | | 2/1891 | Wirt | |
| 719,013 | A | | 1/1903 | Kerr | |
| 898,391 | A | | 9/1908 | Peterson | |
| 917,847 | A | | 4/1909 | Corey | |
| 945,074 | A | | 1/1910 | Bagley | |
| 4,695,114 | A | | 9/1987 | Stanton et al. | 439/573 |
| 5,034,869 | A | | 7/1991 | Choi | 362/363 |
| 5,801,490 | A | * | 9/1998 | Fai | 315/118 |
| 5,964,521 | A | * | 10/1999 | Caya | 362/344 |
| D451,589 | S | * | 12/2001 | Axelsson | D23/387 |
| 6,497,395 | B1 | * | 12/2002 | Croker | 248/300 |

* cited by examiner

*Primary Examiner*—Laura K. Tso
(74) *Attorney, Agent, or Firm*—John F. Salazar; Middleton Reutlinger

(57) ABSTRACT

A support plate for a luminaire of unitary construction includes a planar member portion having a centrally disposed opening therein and a pair of recessed U-shaped cross bar supports adjacent opposed edges of said opening to receive mating end portions of a luminaire support bracket.

14 Claims, 3 Drawing Sheets

SUPPORT PLATE FOR A LUMINAIRE

BACKGROUND OF THE INVENTION

The present invention relates to a lighting fixture hanging system and more particularly to a support plate for a luminaire.

A large number of devices have been provided for hanging light fixtures from room ceilings. Many of these lighting fixtures, such as luminaires, are hung directly to an electrical box, which is concealed above the ceiling. These electrical boxes are positioned so that the lighting fixtures can be wired directly to the electrical wires extending from the boxes. However, luminaires (fixtures) weighing 25 pounds or more are very often too heavy to mount directly to typically installed outlet boxes. Support plates attached to the ceiling may also be provided for detachably connecting luminaires or other support assemblies for luminaires to the ceiling and in turn the electrical outlet boxes. The support plates for the lighting fixtures, and the like, are fixedly attached to the ceiling and in making the detachable connections of the lighting fixtures, connecting devices are generally not easily accessible and can become cumbersome in repairing or replacing one lighting fixture with another.

SUMMARY OF THE INVENTION

It is an object of the present invention to provide a support plate for a luminaire for detachably receiving a luminaire support bracket.

It is another object of the present invention to provide a support plate for a luminaire which is relatively inexpensive, easy to install and provides easy access for detachably connecting luminaire supports.

The present invention provides a support plate to hang a luminaire from a ceiling. The support plate is fastened to the ceiling for support of a luminaire, crossbar or luminaire support bracket, and an outlet box. The support plate includes a recessed area for clearance of the crossbar or luminaire support bracket.

More particularly, the present invention provides a support plate for a luminaire, which includes a planar member having a centrally disposed opening therein. A pair of U-shaped crossbar supports is positioned adjacent opposed edges of the opening and disposed within the opening. Each of the crossbars is recessed in relation to the outer periphery of the planar member and extends from the edges of the opening. The spaced crossbars are disposed to receive a luminaire support bracket to which a luminaire, such as a chandelier or the like, is attached.

Additional objects, features, and advantage of the invention will become apparent to those skilled in the art upon consideration of the following detailed description exemplifying the best mode of carrying out the invention as presently perceived. The detailed description particularly refers to the accompanying figures in which:

DETAILED DESCRIPTION OF THE PREFERRED EMBODIMENTS

Figure 2:
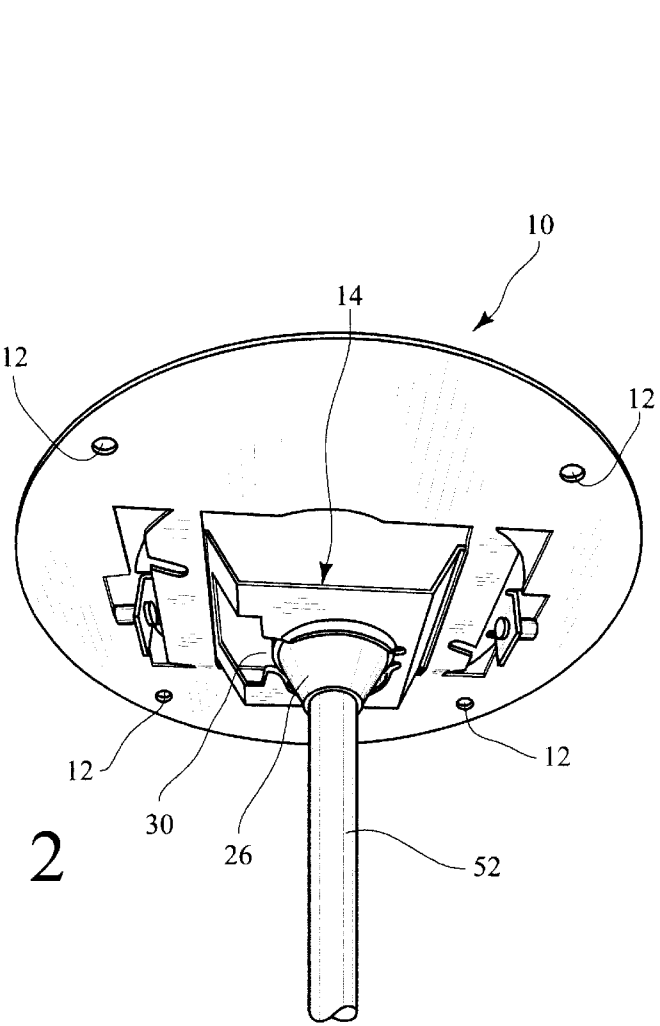
FIG. 2 is a perspective view of the lighting fixture hanging system of FIG. 1 with the housing for the luminaire support bracket removed.
Figure 1:
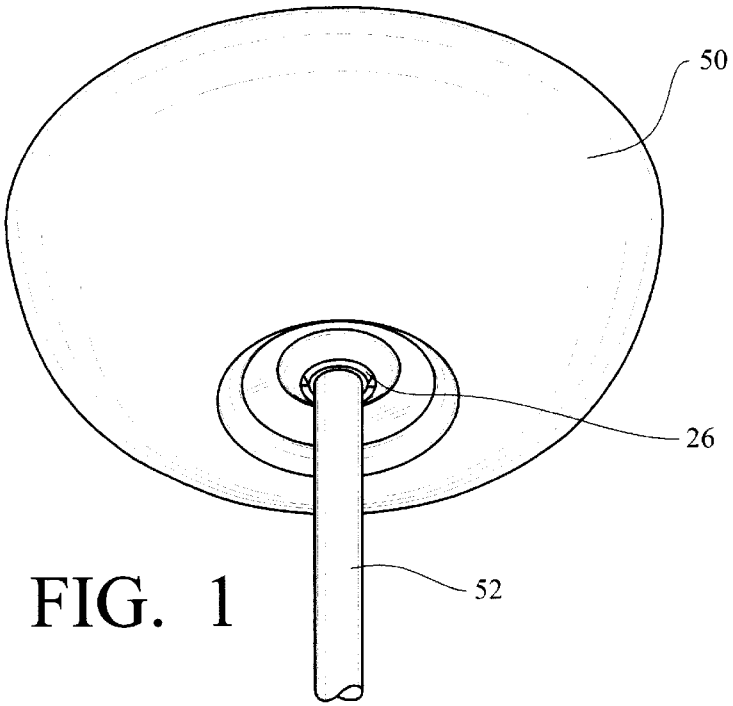
FIG. 1 is a perspective view of a lighting fixture hanging system including a support plate of the present invention.
Figure 3:
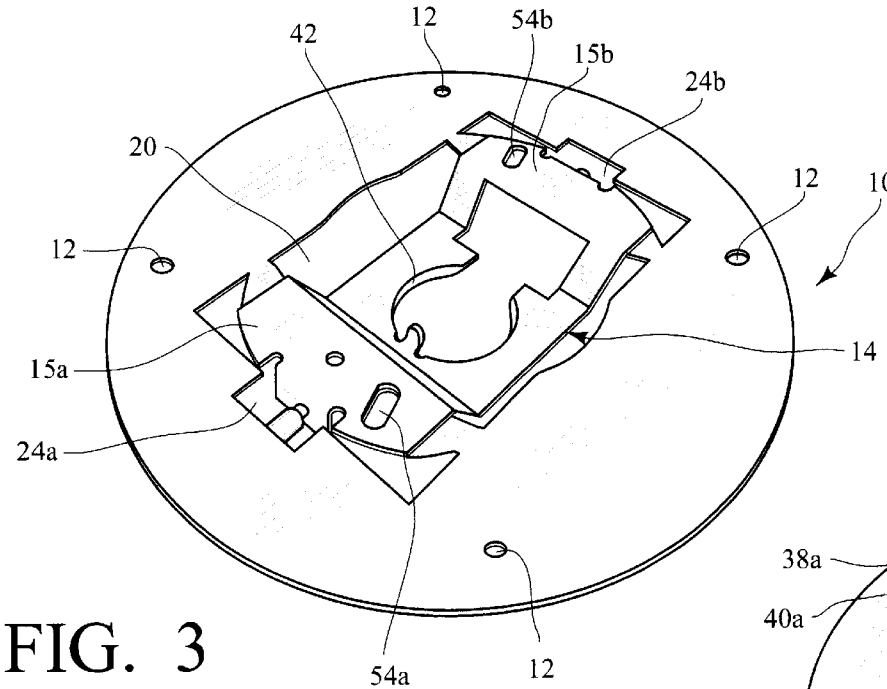
FIG. 3 is a perspective view of a support plate of the present invention as seen from the top surface of the support plate with a luminaire support bracket in place.
Figure 4:
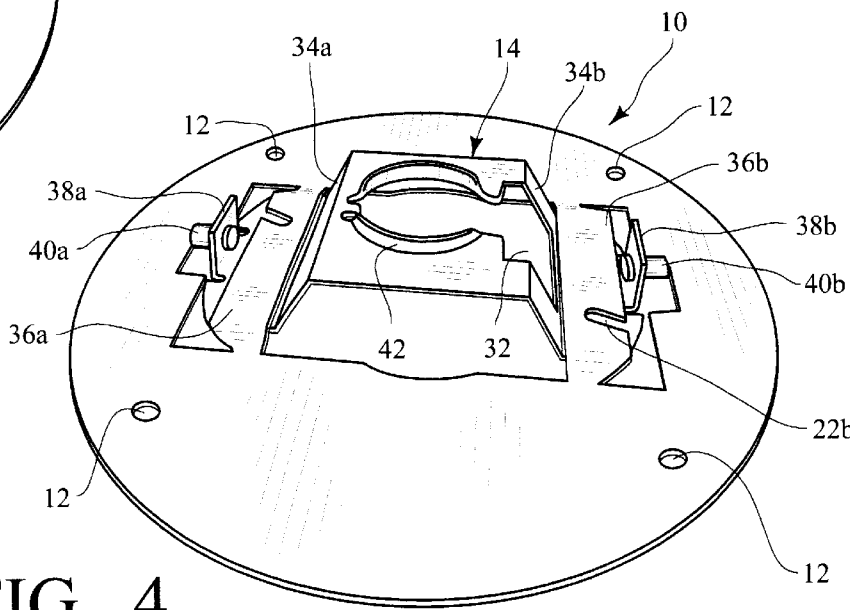
FIG. 4 is a perspective view of the support plate of FIG. 3 as seen from the bottom surface of the support plate with a luminaire support bracket in position; and, FIG. 5 is a top view of the support plate of FIGS. 3 and 4.

Referring to FIGS. 1 and 2 of the drawings, a lighting fixture is shown attached to a ceiling which may be made of plywood, sheet rock, or the like, for supporting a lighting fixture directly thereto. As shown in FIG. 1, a canopy 50 is provided to encase a support plate 10 and a luminaire support bracket 14. An elongated luminaire hanging pole, identified by the numeral 52, is threadably attached to a swivel ball 26 which is received within an opening 30 in the luminaire support bracket 14.

As shown in FIGS. 2–5, the support plate 10 is provided with a plurality of mounting holes 12 for mounting the support plate to the ceiling, the plate forming a flat planar surface or member 11 which supports the luminaire to the ceiling. The support plate 10 is provided with a pair of crossbar supports 16*a* and 16*b* for receiving the outwardly extending support ends 15*a* and 15*b* of the luminaire support bracket 14. Crossbar supports 16*a* and 16*b* may be recessed out of the plane formed by the support plate 10 by legs 18*a*–18*d*. Each of the outwardly extending ends 15*a*, 15*b* of the luminaire support bracket 14 is disposed to be received by the crossbar supports 16*a* and 16*b*. Ends 15*a* and 15*b* are provided with flanges 38*a*, 38*b* for engaging with outer edges of the crossbar supports 16*a* and 16*b*. The flanges 38*a* and 38*b* are also provided with openings therein to receive crossbar screws 40*a* and 40*b*, allowing canopy 50 to be secured to the luminaire support bracket 14 and hold canopy 50 adjacent to the ceiling.

The luminaire support bracket 14, being of U-shaped construction, includes a recessed support section 42 in which a swivel ball receiving opening 30 is disposed therein. A slotted opening 32 is provided in one of the vertical walls 34*a* or 34*b* for receiving the swivel ball 26.

Figure 5:
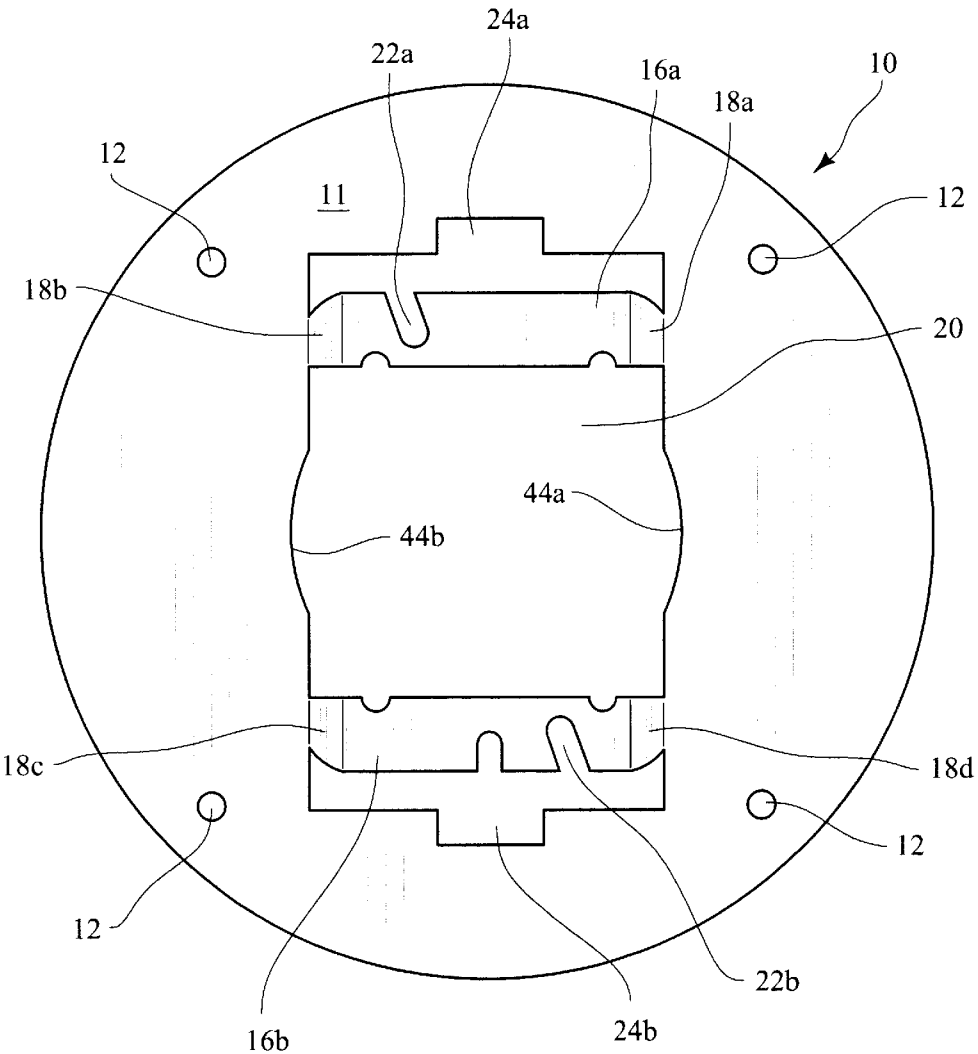

As best shown in FIG. 5, the support plate 10 is provided with crossbar support legs 18*a*, 18*b*, 18*c*, and 18*d* which attach the crossbar supports 16*a* and 16*b* within the opening 20 of the plate 10. Crossbar support legs 18*a*, 18*b*, 18*c* and 18*d* may be angled at 45° relative to the planar support plate 10 thus forming the recessed area for clearance of crossbar supports 16*a* and 16*b*. The recessed area defined by the support legs may extend outward from about 0.08 inch, more or less, depending on the thickness of the material forming the support plate 10 and the support bracket 14. Thus, legs allow the support bracket to be recessed into the same plane defined by the plate 30. The crossbar supports 16*a* and 16*b* are also provided with slots 22*a* and 22*b* therein which are in mating relation with slots 54*a* and 54*b* in the ends 36*a* and 36*b* of the luminaire support bracket 14 for maintaining the luminaire support bracket 14 in a fixed position. Slots 22*a*, 22*b* are angled inwardly in line with a center point of the opening 20. An opening 20, generally of rectangular configuration, is also provided with opposed elliptically-shaped outer edges 44*a*, 44*b*, which provides for the ease of electrical connection/installation of the luminaire support bracket 14 therein, the luminaire support bracket 14 being inserted through the opening 20 for mounting onto the crossbar supports 16*a* and 16*b*. The opening 20 has a length greater than a width, and the crossbar supports 16*a*, 16*b* with legs 18*a*, 18*b*, 18*c*, 18*d* extending across the width of opening 20. Cut outs 24*a* and 24*b* at opposed ends of opening 20 and equal distance from each corner of the opening 20 is provided to allow clearance of screws 40*a* and 40*b* during assembly.

Although the invention has been described in detail with reference to a preferred embodiment and a specific example, variations and modifications exist within the scope and spirit of the invention as described and defined in the following claims.

What is claimed is:

1. A support plate for a luminaire comprising:

a planar member having a centrally disposed opening;

a pair of U-shaped crossbar supports adjacent opposed edges of said opening and disposed within said opening, each of said crossbar supports being recessed in relation to an outer periphery of said planar member and said crossbar supports being in spaced parallel relationship.

2. The support plate of claim 1 including bolt receiving slots in each of said crossbar supports.

3. The support plate of claim 2, said slots being angled inwardly and in line with a center point of said opening.

4. The support plate of claim 1, said opening being of substantially rectangular configuration, said crossbar supports being spaced from opposed edges, said opposed edges having cut-outs therein transverse to a location equal distance from each corner of said opening.

5. The support plate of claim 1, said opening being of substantially rectangular configuration having a length greater than a width, said crossbar supports extending across said width of said opening.

6. The support plate of claim 1 being of unitary construction.

7. A support plate for a luminaire and a luminaire support bracket comprising:

a luminaire support bracket of U-shaped configuration having a recessed support member with an opening therein to receive a swivel ball and a pair of opposed outwardly extending end portions adapted to be received by crossbar supports of a support plate;

a support plate having a planar portion with a centrally disposed opening therein and a pair of recessed U-shaped crossbar supports adjacent opposed edges of said opening engageable in mating relation with said end portions of said luminaire support bracket.

8. The support plate of claim 7 including bolt receiving slots in each of said crossbar supports.

9. The support plate of claim 8, said slots being angled inwardly and in line with a center point of said opening.

10. The support plate of claim 7, said opening being of substantially rectangular configuration, said crossbar supports being spaced from opposed edges, said opposed edges having cut-outs therein transverse to a location equal distance from each corner of said opening.

11. The support plate of claim 7 said opening being of substantially rectangular configuration having a length greater than a width, said crossbar supports extending across said width of said opening.

12. The support plate of claim 7 being of unitary construction.

13. A support plate for a hanging luminaire, comprising:

a flat planar surface having an opening formed therein which receives a luminaire support bracket;

a first and a second crossbar support extending across said opening in said flat planar surface, said first and said second crossbar support affixed to said flat planar surface by support legs, said support legs angled outwardly from said flat planar surface.

14. A support plate in combination with a luminaire support bracket, comprising:

a planar support plate having an opening therein;

a first and a second cross bar support spanning said opening in said planar support plate, said first and second cross bar supports each having a support leg at opposite ends, each of said legs extending outward from said planar support plate;

a luminaire support bracket having a first support end and a second support end, said first support end supported by said first cross bar support and said second support end supported by said second cross bar support, said first and said second support end held within a plane formed by said planar support plate.

* * * * *